US011355837B1

(12) United States Patent
Vincenzi

(10) Patent No.: US 11,355,837 B1
(45) Date of Patent: Jun. 7, 2022

(54) INFLATABLE ANTENNA COVER

(71) Applicant: AMAZON TECHNOLOGIES, INC., Seattle, WA (US)

(72) Inventor: Giancarlo Vincenzi, Bellevue, WA (US)

(73) Assignee: AMAZON TECHNOLOGIES, INC., Seattle, WA (US)

( * ) Notice: Subject to any disclaimer, the term of this patent is extended or adjusted under 35 U.S.C. 154(b) by 200 days.

(21) Appl. No.: 16/819,987

(22) Filed: Mar. 16, 2020

(51) Int. Cl.
*H01Q 1/42* (2006.01)
*H01Q 1/02* (2006.01)

(52) U.S. Cl.
CPC ..... *H01Q 1/428* (2013.01); *H01Q 1/02* (2013.01); *H01Q 1/427* (2013.01)

(58) Field of Classification Search
CPC ..... H01Q 1/42; H01Q 1/427; H01Q 1/428; H01Q 1/02
See application file for complete search history.

(56) References Cited

U.S. PATENT DOCUMENTS 2,953,021 A * 9/1960 Goettelman ..... H01Q 1/02 73/170.26
2,959,785 A * 11/1960 Leatherman ..... H01Q 1/427 343/872
6,439,505 B1 8/2002 Hyde et al.

FOREIGN PATENT DOCUMENTS

EP 0466839 B1 1/1996

OTHER PUBLICATIONS

"Introducing the World's First Portable Radome with Optional De-Icing", Portable Radome, Walton De-Ice, Retrieved from the Internet: www.de-ice.com/portableradome.html, 3 pages.

* cited by examiner

*Primary Examiner* — Hoang V Nguyen
(74) *Attorney, Agent, or Firm* — Lindauer Law, PLLC

(57) ABSTRACT

Accumulation of debris, snow, ice, wildlife, insects, and other contaminants adversely affect antennas that are mounted outdoors. An antenna comprises a housing and a removeable inflatable cover. The housing may include one or more engagement features, such as a perimeter channel into which perimeter of an opening of the covering is retained. The covering may be selectively inflated to produce a motion in the covering that displaces accumulated contaminants and discourages further accumulation. Heaters may warm air inside the covering to facilitate melting of ice. Inflation of the covering may be responsive to environmental conditions. For example, during high wind conditions, the covering may be evacuated and retained in a collapsed configuration to reduce damage.

20 Claims, 9 Drawing Sheets

Control Sequence 410

| Time 412 | Chamber(s) Inflated 414 |
|---|---|
| 0 | 1 |
| 1 | 1,2 |
| 2 | 2,3 |
| 3 | 3,4 |
| 4 | 4,5 |
| 5 | 1,2,3,4,5 |

Control Sequence 510

| Time 512 | Fan Speed 514 | Inlet Valve State 516 | Relief Valve State 518 | Recirc. Valve State 520 |
|---|---|---|---|---|
| 0 | 10 | Open | Closed | Closed |
| 1 | 6 | Open | Closed | Closed |
| 2 | 0 | Closed | Closed | Open |
| 3 | 0 | Closed | Open | Open |

800

Operational Limit Data 644

| Parameter 802 | Minimum Limit 804 | Maximum Limit 806 |
|---|---|---|
| Wind Speed | 0 m/s | 14 m/s |
| Wind Direction (relative) | -45 degrees | + 45 degrees |
| Temperature | -20 C | 1 C |
| Precipitation | 0 cm | 30 cm |
| Relative Humidity | 35% | 100% |
| Barometer | 980 mb | 1050 mb |
| Motor Back EMF | 0 V | 1 V |
| Accelerometer | 0 m/s | 0.1 m/s |
| Tilt Angle | 0 degrees | 10 degrees |
| Vibration (0-255) | 0 | 15 |
| ... | ... | ... |

Current Condition Data 642

| Parameter 802 | Condition Value 808 |
|---|---|
| Wind Speed | 17 m/s |
| Wind Direction | 3 degrees (relative) |
| Temperature | -2 C |
| Precipitation | 3 cm |
| Relative Humidity | 5% |
| Barometer | 995 mb |
| Motor Back EMF | 0.1 V |
| Accelerometer | 0.02 m/s |
| Tilt Angle | 2 degrees |
| Vibration | 35 |
| ... | ... |

FIG. 8

INFLATABLE ANTENNA COVER

BACKGROUND

An outdoor antenna may accumulate debris, such as ice, snow, leaves, wildlife, material brought or deposited by wildlife, and so forth. Such accumulation may adversely affect performance of the antenna.

BRIEF DESCRIPTION OF FIGURES

The detailed description is set forth with reference to the accompanying figures. In the figures, the left-most digit(s) of a reference number identifies the figure in which the reference number first appears. The use of the same reference numbers in different figures indicates similar or identical items or features. The figures are not necessarily drawn to scale, and in some figures, the proportions or other aspects may be exaggerated to facilitate comprehension of particular aspects.

FIG. 8 illustrates operational limit data and current condition data that may be used to control inflation of the removeable inflatable cover, according to some implementations.

Figure 1:
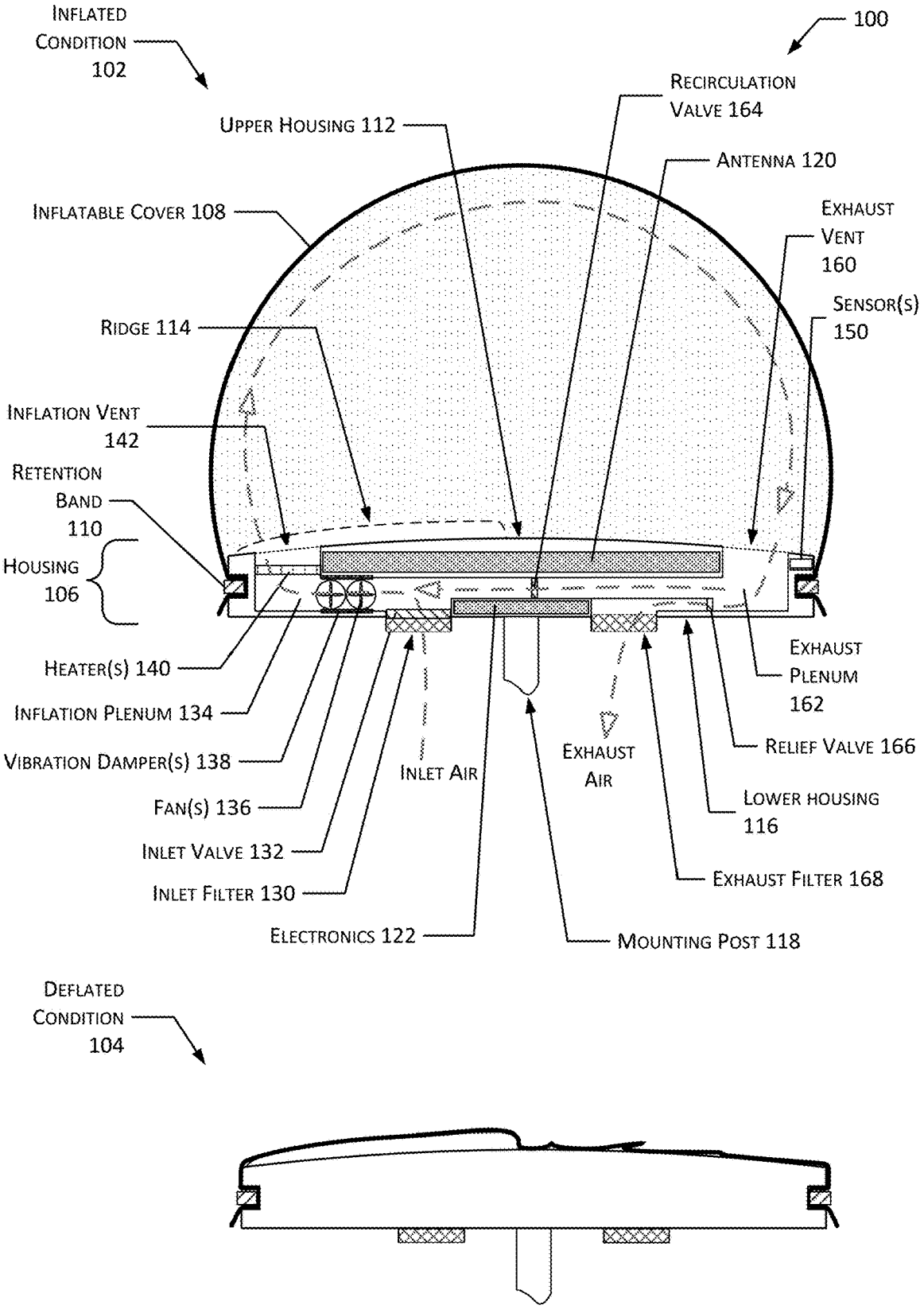
FIG. 1 illustrates a device that includes a housing with an antenna and a removeable inflatable cover affixed to the housing, according to some implementations.

While implementations are described herein by way of example, those skilled in the art will recognize that the implementations are not limited to the examples or figures described. It should be understood that the figures and detailed description thereto are not intended to limit implementations to the particular form disclosed but, on the contrary, the intention is to cover all modifications, equivalents, and alternatives falling within the spirit and scope as defined by the appended claims. The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean "including, but not limited to".

DETAILED DESCRIPTION

Antennas are used to send, receive, or transmit and receive electromagnetic signals. For example, a first antenna may be used by a first station to send and receive radio signals to a second antenna used by a second station. A signal between the two antennas may be attenuated, or reduced in strength, by obstacles along a path traveled by the signal. For example, a brick wall between the two stations will attenuate the signal transmitted by the first station, resulting in a reduced received signal strength at the second station. A reduction in signal strength may reduce the amount of data that can be transmitted at a given time, or even cause a link between the stations to fail.

An antenna may be used by the first station to send and receive radio signals with other stations. These stations may be fixed terrestrial stations, aerial stations, mobile stations along the surface of the Earth, a satellite in orbit, and so forth. For example, the first station may be mounted at a user's home or business. The first station may use the antenna to establish a radio link with the second station, such as a fixed terrestrial station, aerial station, satellite, and so forth. The radio link may be used to transfer data between the first station and the second station.

To minimize attenuation, an antenna on the first station may be mounted outdoors to provide a clear line of sight to the second station. In some implementations it may be advantageous to use an antenna that provides some directionality. For example, directionality may result in some gain or increase in amplitude of a signal received from a specified direction, may attenuate signals from directions other than the specified direction, and so forth.

The antenna may comprise a phased array of antenna elements. A phased array comprises many smaller antenna elements. Signals between the antenna elements and a radio receiver or transmitter are carefully controlled to provide a particular phase or timing difference. As a result of the phase differences, it is possible to electronically steer radio signals to or from a particular direction. The many antenna elements in the phased array may be mounted to a support structure to maintain a predetermined spacing and arrangement of those antenna elements. In many implementations, the phased array within an enclosure resembles a flat slab or cylinder. For example, if the antenna comprises a phased array suitable for use at microwave frequencies, the enclosure may be circular and approximately 50 centimeters (cm) in diameter and 5 cm tall.

The antenna using a phased array antenna and the ability to electronically steer the beam for transmission and reception of radio signals without any moving parts is particularly suitable for use when one or both stations are moving. Returning to the earlier example, if the first station is fixed at a user's home and is in communication with satellites moving overhead, the phased array antenna when steered towards the satellite provides an increase in received signal from the satellite and increases the power of the signal sent to the satellite.

As described above, the path between antennas at different stations should be free from obstacles. In the case where the phased array antenna is in use to communicate with stations moving overhead, such as a constellation of satellites, the ideal case is to have an unobstructed view of the sky from horizon to horizon in all compass directions. In the best situation, the phased array antenna is mounted to be perpendicular to vertical, or flat, and as high as possible, such as on a rooftop.

However, as mentioned above, the overall form factor of a phased array antenna is flat. The overall flat shape of the antenna with a relatively large surface area, combined with being exposed to the sky results in a situation in which the antenna becomes an ideal platform to accumulate debris. Ice may cover the antenna. Snow may fall and cover the antenna. Leaves may fall on the antenna. Wildlife such as birds, squirrels, bats, and so forth may find such a high, flat place ideal to congregate or build nests. The wildlife may further add to the problem by depositing waste material on the antenna. Debris on the antenna attenuates radio signals to and from the antenna, degrading or even precluding radio communication.

Traditional techniques to mitigate debris accumulation involve a fixed enclosure above the antenna. However, this fixed enclosure experiences several drawbacks. Fixed enclosures are typically expensive to construct and maintain, particularly because they are exposed to the harsh outdoor environment. A rigid structure may be exposed to significant wind loading, requiring substantial structural rigidity to avoid structural failure. Fixed enclosures may also retain debris depending on shape, and remain an attractive location for wildlife to visit and loiter. Additionally, traditional structures affect radio signal propagation. For example, the rigid enclosure may attenuate, refract, reflect, or otherwise affect radio signals passing through the rigid enclosure. This may also adversely change where a beam is steered, by introducing phase delays due to variations in materials, relative position, and so forth.

Described in this disclosure is a device that includes an antenna that is covered by a removeable inflatable cover. The antenna may be planar in overall form factor, such as a phased array, with its plane arranged perpendicular to vertical. Extending over the antenna is the removeable inflatable cover. An air system controls the movement of air between the interior of the inflatable cover and the surrounding environment. The air system may include a heater to warm the air within the inflatable cover to reduce or eliminate accumulation of water, snow, or ice on the inflatable cover.

The air system may be responsive to current conditions. For example, the inflatable cover may be maintained in an inflated condition when local wind speed is less than a maximum limit of 14 meters/second (m/s). If the local wind speed exceeds this maximum limit, the air system may evacuate the air from within the inflatable cover. Once evacuated, the inflatable cover is held firmly against a housing of the device by ambient air pressure. When the high winds subside, the inflatable cover may be re-inflated.

Other conditions may be used to control inflation. For example, the device may include a strain sensor. Data from the strain sensor may indicate that weight on the device has exceeded a threshold. For example, a flock of birds may have landed or snow may have accumulated on the device. Responsive to weight data indicating a load on the device has exceed a threshold value, the air system may be cycled between an inflated and a deflated state.

The inflatable cover may be inflated to produce movement. Such movement may be used to prevent accumulation of debris, or displace accumulated debris such as snow, discourage wildlife, and so forth.

In one implementation the inflatable cover may be inflated and deflated. In another implementation the inflatable cover may comprise a plurality of chambers. Fenestrations or openings between the chambers may allow some air to pass between adjacent chambers. By changing the rate at which a fan supplies air to a first chamber, the subsequent movement of air through the fenestrations to other chambers may be changed. For example, a pulse of air may be created. As this pulse moves through the chambers, the inflatable cover may exhibit a rippling or peristaltic motion.

In still another implementation, the inflatable cover may comprise a plurality of chambers. Each chamber may be connected to one or more valves to control supply air entering the chamber or exhaust air leaving the chamber. These valves may be operated to produce various patterns of inflation of the chambers to produce movement in the inflatable cover. For example, a first chamber may be inflated while an adjacent second chamber is deflated, producing a rippling or peristaltic motion.

Field replacement of the inflatable cover is easy, reducing labor costs associated with maintenance. As mentioned above, the outdoor environment is harsh. In the event the inflatable cover is damaged, it is easily disconnected from the housing and a replacement inflatable cover is attached.

The inflatable cover allows for easy modification to reduce visual impact. The inflatable cover may be available in various colors, patterns, textures, and so forth. An appropriate inflatable cover may be selected that blends in with the surrounding environment. For example, the inflatable cover may be selected with a color that matches the surrounding construction materials, such as roofing, near where the device will be installed. This allows the device to be used in areas which would otherwise be prohibited due to local rules.

By using the device described in this disclosure, an antenna may be inexpensively, effectively, and without human intervention maintained free of debris for extended periods of time. Operation of the inflatable cover is responsive to current or anticipated conditions, allowing for improved reliability and improved clearance of debris. By keeping the debris clear of the antenna, performance of the radio link using the antenna is significantly improved. Improved signal to noise ratios are obtained, link quality is improved, data throughput is improved, transmitter power consumption is reduced, and so forth. When needed or desired, the inflatable cover is easily removeable without the need to dismount the antenna. This substantially reduces ongoing operational expenditures associated with maintaining and operating the system.

Illustrative System

FIG. 1 illustrates a device 100 in an inflated condition 102 and a deflated condition 104. The device 100 includes a housing 106 with an inflatable cover 108. The inflatable cover 108 is removably attached to the housing 106, allowing the inflatable cover 108 to be attached to and removed from the housing 106. For example, a retention band 110 may be used to retain a lower portion of the inflatable cover 108 within a channel or groove extending along a perimeter of the housing 106.

The housing 106 may comprise an upper housing 112. One or more features such as a ridge 114 may extend from, or be attached to, the upper housing 112. The ridge 114 is described in more detail with regard to FIG. 2. The upper housing 112 may comprise a material that is transparent to radio frequency signals within one or more bands.

The housing 106 may comprise a lower housing 116. A mounting post 118 or other structure may be used to affix the device 100 to a support structure such as a mast, roof mount, tower, and so forth.

An antenna 120 is arranged within the housing 1061 proximate to the upper housing 112. The antenna 120 may comprise one or more antenna elements. For example, the antenna 120 may comprise a phased array antenna.

The housing 106 may include electronics 122 that include, but are not limited to, a controller, a radio transmitter, a radio receiver, a modem, and so forth. For example, the electronics 122 may include a controller to operate an air system to inflate the inflatable cover 108.

The air system may be arranged within the housing 106. In some implementations the air system may comprise an additional unit that is affixed to, or outboard of, the housing 106.

Inlet air for use by the air system to inflate the inflatable cover 108 may be obtained from the surrounding environment. The inlet air may pass through an inlet filter 130. An inlet valve 132 may be used to control passage of air between the ambient environment and an inflation plenum 134. The valves described herein may include, but are not limited to motor actuated gate valves, butterfly valves, ball valves, and so forth.

Within the inflation plenum 134 are one or more fans 136 to move air. The fans 136 may comprise one or more fans of one or more types. Types of fans may include axial flow, centrifugal, cross-flow, and so forth. In one implementation the fans 136 may comprise an axial flow fan comprising a plurality of fan blades rotated by a brushless direct current (BLDC) motor. In other implementations other devices may be used instead of, or in addition to, the fans 136. For example, a bellows, piston, and so forth may be used to move air.

One or more vibration dampers 138 may be installed between the one or more fans 136 and other parts of the device 100. For example, the vibration dampers 138 may comprise elastomeric members that reduce or eliminate the transfer of mechanical vibration from the fans to an internal frame of the device 100. By reducing the transfer of vibration to the other parts of the device 100, longevity of other components may be improved. For example, by reducing transfer of vibration, the longevity of the electronics 122 and the antenna 120 may be increased.

One or more heaters 140 may be positioned at least partially within the inflation plenum 134. For example, the one or more heaters 140 may comprise electrically resistive elements that transform electrical energy to heat. The one or more heaters 140 may be used to increase the temperature of air. For example, the heaters 140 may be activated during freezing conditions to prevent accumulation of snow and ice on the exterior of the inflatable cover 108.

An inflation vent 142 provides a passage for air to move from the inflation plenum 134 into an interior of the inflatable cover 108. In some implementations the inflation vent 142 may include a grate, filter, or other features. Air is emitted from the inflation vent 142 and passed into one or more chambers of the inflatable cover 108. In this illustration, the inflation vent 142 is positioned in the upper housing 112. In other implementations, the inflation vent 142 may positioned in other configurations. For example, the inflation vent 142 may comprise a passage extending along at least a portion of a circumference of the housing 106 with a plurality of openings between where the inflatable cover 108 is affixed to the housing 106 and the interior of the inflatable cover 108.

In this illustration, the inflatable cover 108 is depicted as having a single chamber. In other implementations, the inflatable cover 108 may comprise a plurality of chambers. This is discussed with regard to FIG. 3.

The device 100 may include one or more sensors 150. These sensors 150 may provide information about the surrounding environment, operation of one or more components of the device 100, and so forth. The sensors 150 are discussed with regard to FIG. 7.

An exhaust vent 160 provides a passage for the air to move from the interior of the inflatable cover 108 into an exhaust plenum 162. Air may move between the exhaust plenum 162 and the inflation plenum 134 as controlled by a recirculation valve 164. For example, the recirculation valve 164 may be opened to permit air as urged by the fans 136 to move from the exhaust plenum 162, past the heaters 140, to return into the interior of the inflatable cover 108. If pressure within the inflatable cover 108 is to be increased, the recirculation valve 164 may be closed, the inlet valve 132 opened, and additional air moved from the surrounding environment into the inflatable cover 108.

The exhaust plenum 162 may also include a relief valve 166. The relief valve 166 allows for control of air between the exhaust plenum 162 and the surrounding environment. An exhaust filter 168 may be positioned between the relief valve 166 and the surrounding environment.

The air system may be used to selectively inflate and deflate the inflatable cover 108. As shown in the inflated condition 102, the inflatable cover 108 has been pressured and maintained in a particular shape that is approximately hemispherical. In other implementations the inflatable cover 108 may have other shapes. For example, the inflatable cover 108 in the inflated condition may form a pyramid, cone, cylinder, cuboid, or other shape. These shapes may be irregular polygons. For example, the shape of the inflatable cover 108 may form the appearance of a decoration, fictional character, and so forth.

In the deflated condition 104 a net zero differential in pressure between the interior of the inflatable cover 108 and the exterior environment may be observed. For example, the fans 136 may be turned off and the relief valve 166 may be opened fully, resulting in depressurization of the inflatable cover 108.

In some implementations the deflated condition 104 may be attained by actively evacuating the interior of the inflatable cover 108. For example, the relief valve 166 and the recirculation valve 164 may be closed, the inlet valve 132 opened, and direction of airflow from the fans 136 reversed to move air from the interior of the inflatable cover 108 to the surrounding environment. In this configuration, a slight pressure differential may exist for at least some time in which the ambient air pressure in the surrounding environment is greater than the air pressure within at least a portion of the inflation plenum 134.

Figure 2:
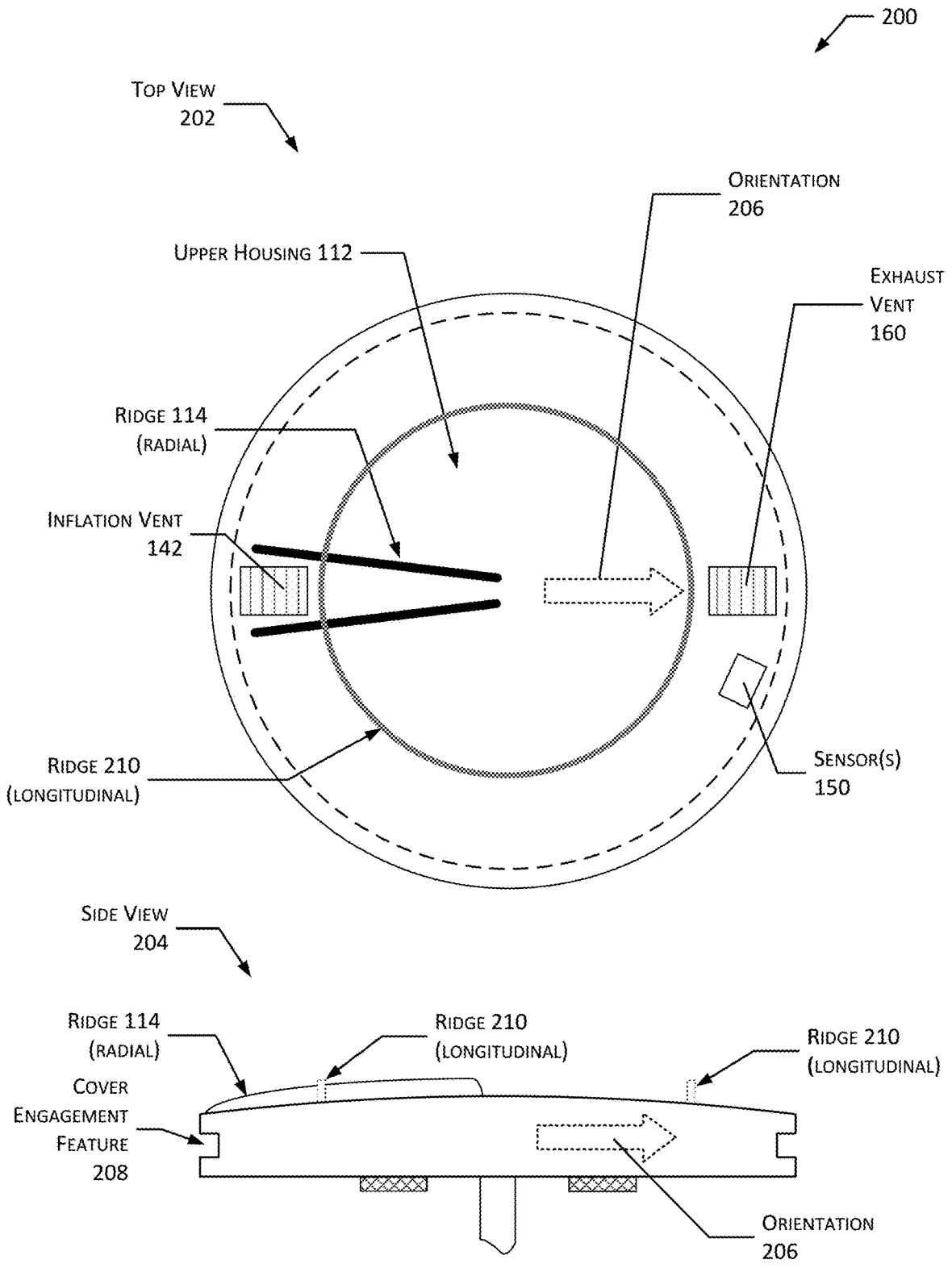
FIG. 2 illustrates top and side views of the housing and a feature used to mechanically engage a portion of the removeable inflatable cover, according to some implementations.

FIG. 2 illustrates at 200 a top view 202 and a side view 204 of the housing 106 with the inflatable cover 108 removed, according to one implementation. In the top view 202, the upper housing 112 is visible. One or more ridges 114 may be present on the upper housing 112. For example, a pair of ridges 114 are shown, extending radially from a center of the upper housing 112 to proximate to the inflation vent 142. In other implementations more or fewer ridges 114 may be used. In another implementation that may be used instead of, or in addition to the radial ridge 114, the upper housing 112 may include one or more longitudinal ridges 210. For example, a single longitudinal ridge 210 is depicted.

During operation, the ridge 114 or other features may be used to facilitate inflation of the inflatable cover 108 in the event there is a load upon the inflatable cover 108. For example, if the inflatable cover 108 is in the deflated condition 104 during a snowstorm, a heavy thickness of snow may be sitting on the deflated inflatable cover 108. The ridges 114 may provide an open passageway for air to move from the inflation vent 142 into the inflatable cover 108. In one situation, the air system is operated to force air into the interior of the inflatable cover 108 between the ridges 114. The inflatable cover 108, weighted down by the snow, may be pressed thereon. As inflation begins, the ridges 114 initially confine air to a smaller area, preferentially inflating a portion of the inflatable cover 108. This introduces an asymmetry that serves to displace the load upon the inflatable cover 108.

Also shown is the exhaust vent 160. In other implementations, other configurations of exhaust vent 160 may be used. For example, the exhaust vent 160 may comprise a passage extending along at least a portion of a circumference of the housing 106 with a plurality of openings between where the inflatable cover 108 is affixed to the housing 106 and the interior of the inflatable cover 108.

One or more sensors 150 may be arranged on or proximate to the upper housing 112. For example, the sensors 150 may include a proximity sensor. The proximity sensor may be used to determine presence of an object atop the upper housing 112.

The device 100 may exhibit an orientation 206. For example, the orientation 206 of the device 100 upon installation may be determined using a compass, manual input, and so forth. Information about the orientation 206 may be used to control the operation of the antenna 120. For example, information about the orientation 206 may be used to determine which direction, relative to the antenna 120, to direct a beam.

The orientation 206 of the device 100 may also be used by the air system. For example, given the known orientation 206 of the device 100 and information about local wind speed and direction, the air system may inflate, deflate, or partially inflate the inflatable cover 108 to present a particular profile or configuration of the inflatable cover 108 given those wind conditions.

The side view 204 shows the cover engagement feature 208 extending around a perimeter of the housing 106. In one implementation the cover engagement feature 208 may comprise a groove or channel. A portion of the inflatable cover 108 may be placed within the cover engagement feature 208 and the retention band 110 may be used to retain the portion of the inflatable cover 108 within the cover engagement feature 208. In another implementation the retention band 110 may comprise a clamp, flexible tape section with teeth to engage a pawl in a head attached to the flexible tape section, hook and loop fastener, and so forth. In another implementation a loop fastener material may be arranged around an exterior perimeter of the housing 106 while a corresponding hook fastener material is arranged around an interior perimeter of an opening in the inflatable cover 108. The hook fastener material may be impressed upon the loop fastener material to affix the inflatable cover 108 to the housing 106.

In yet another implementation, the inflatable cover 108 may include a rigid engagement feature, such as a threaded ring, that mechanically engages corresponding features such as threads on the housing 106. The inflatable cover 108 may thus be screwed onto the housing 106 during installation and unscrewed during removal.

Figure 3:
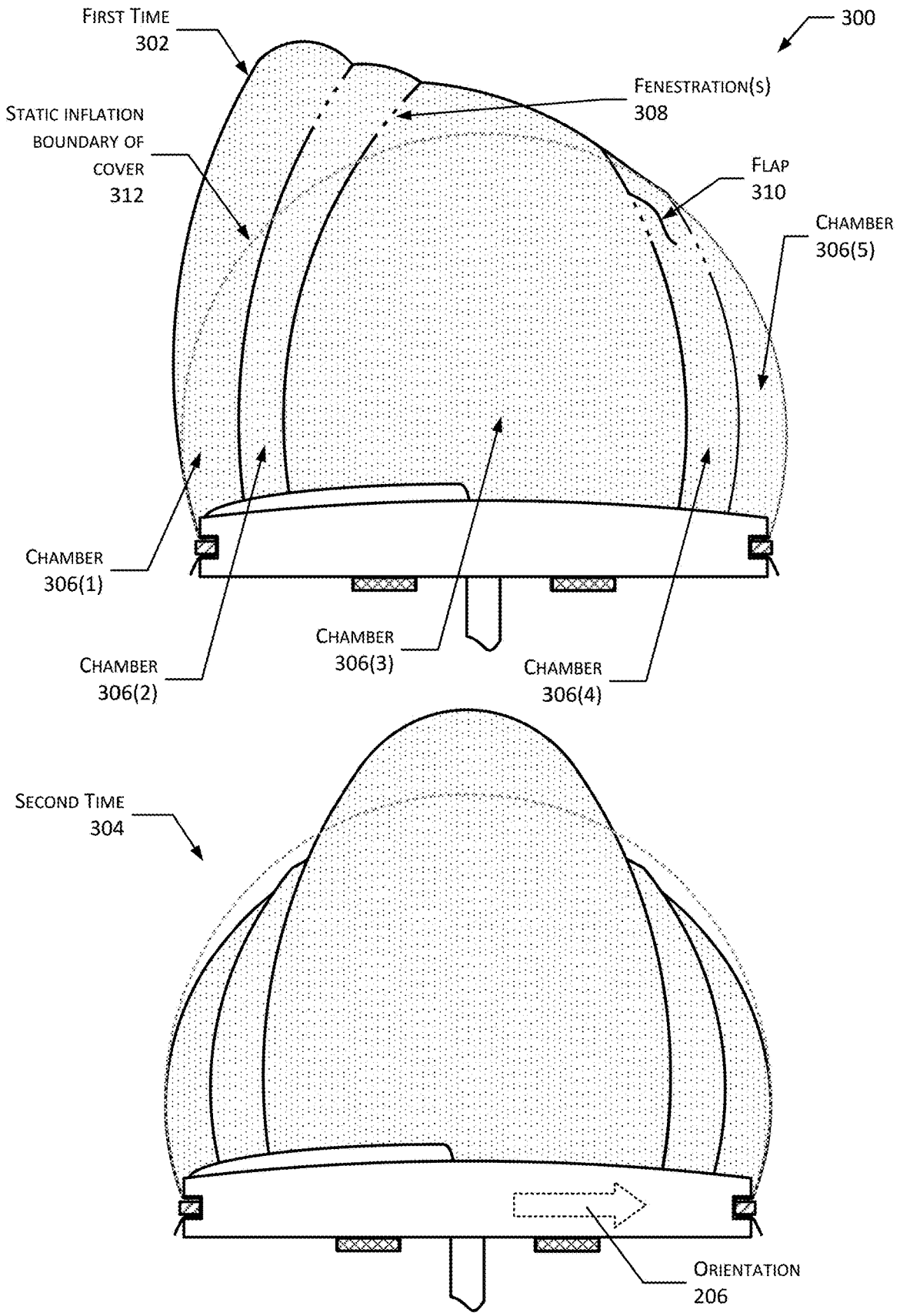
FIG. 3 illustrates a side view of the device at a first time at a first inflation configuration and at a second time at a second inflation configuration, according to some implementations.

FIG. 3 illustrates a side view 300 of the device 100 at a first time 302 at a first inflation configuration and a second time 304 at a second inflation configuration, according to some implementations. In addition to the inflated condition 102 and the deflated condition 104 shown in FIG. 1, the air system may operate to attain various physical configurations of the inflatable cover 108.

The inflatable cover 108 may comprise one or more of fabric, plastic, or composite materials. In some implementations the inflatable cover 108 may be elastomeric. For example, portions of the inflatable cover 108 may stretch when inflated and may return to substantially the same size when deflated.

In the implementation depicted here, the inflatable cover 108 comprises a plurality of chambers 306(1), 306(2), 306(3), 306(4), and 306(5). In other implementations fewer or more chambers 306 may be used.

One or more fenestrations 308 or openings may be provided between adjacent chambers 306. For example, fenestrations 308 in the wall between the first chamber 306(1) and the second chamber 306(2) permit air to flow from the first chamber 306(1) into the second chamber 306(2). In this illustration the fenestrations 308 are proximate to an upper surface of the inflatable cover 108. The area of the fenestrations 308 between chambers 306 may differ. For example, a total area of fenestrations 308 between the first chamber 306(1) and the second chamber 306(2) may be greater than a total area of the fenestrations between the second chamber 306(2) and the third chamber 306(3). These variations in fenestration 308 area may be used to provide a selective movement of a portion of air within the inflatable cover 108.

In some implementations a flap 310 may be used to control the flow of air between chambers 306. For example, the flap 310 may be used to closed one or more fenestrations 308 until a minimum pressure differential across the flap 310 is obtained.

At the first time 302, the air system inflated the first chamber 306(1) and the second chamber 306(2) to produce an asymmetry in the overall shape of the inflatable cover 108. Such an asymmetry may dislodge debris such as snow and ice.

At the second time 304, the centrally located third chamber 306(3) is enlarged by increased inflation, while the other chambers 306(1), 306(2), 306(4), and 306(5) have been deflated to reduce their size. This has produced a bulge in the inflatable cover 108, which may further dislodge debris and urge any such debris off of the inflatable cover 108.

The sequence may continue, producing a ripple or peristaltic effect, with successive chambers 306 being enlarged to produce an asymmetric displacement of the inflatable cover 108.

In some implementations the control sequence may be adjusted based on the orientation 206 of the device 100 and other data. For example, data indicates the wind is blowing from left to right in FIG. 3, that is in the same direction as the orientation 206, the air system may begin the ripple of the inflatable cover 108 on a windward edge and end the ripple on the leeward edge of the inflatable cover 108. By moving the asymmetry of the inflatable cover 108 in the same direction as the prevailing wind, removal of any debris on the inflatable cover 108 may be facilitated.

Also depicted for reference is a static inflation boundary of the cover 312, corresponding to the inflated condition 102 shown in FIG. 1.

Figure 4:
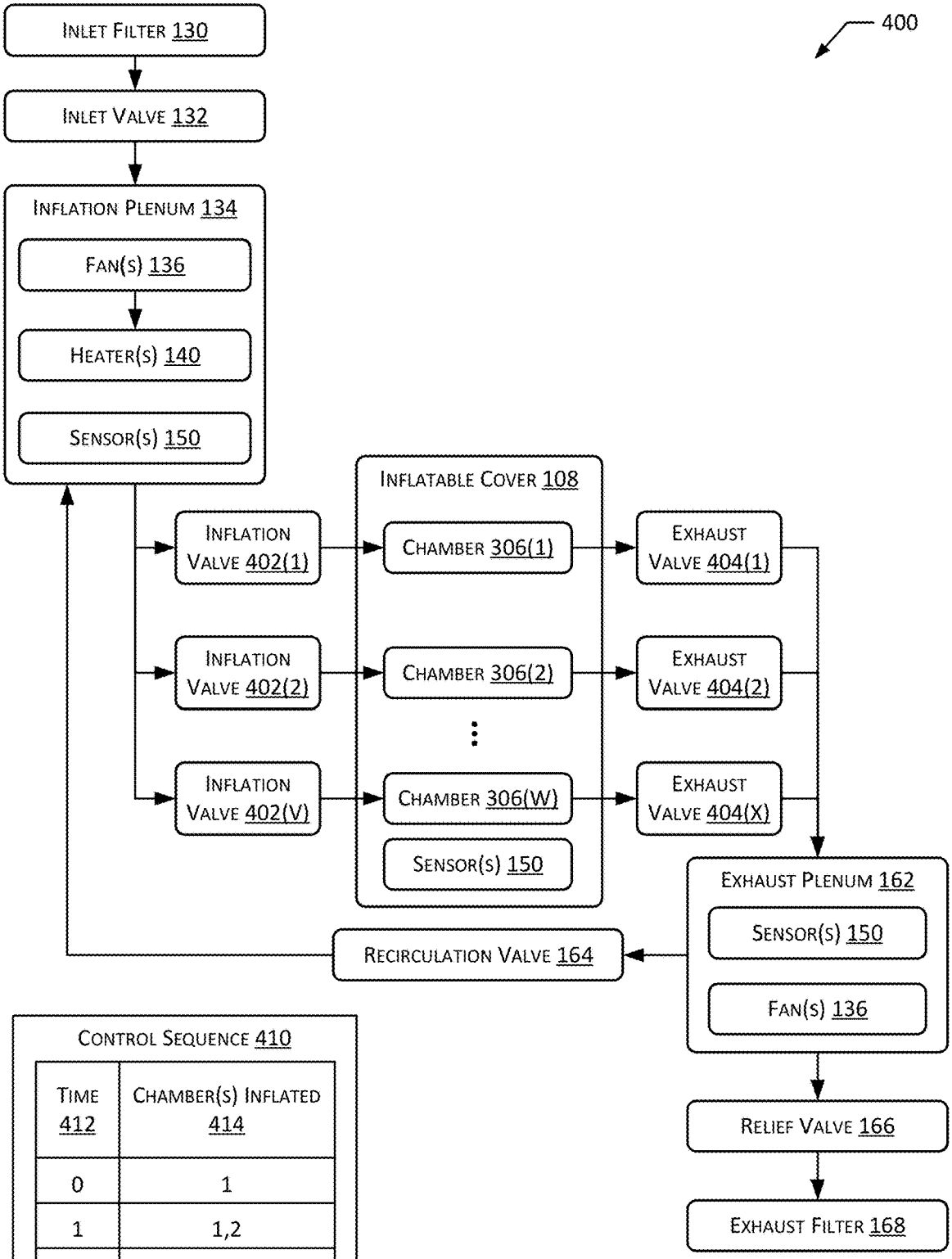
FIG. 4 is a block diagram of a first implementation of an air system of the device and a control sequence, according to some implementations.

FIG. 4 is a block diagram 400 of a first implementation of an air system of the device 100 and a control sequence, according to some implementations.

As described above with regard to FIG. 1, the air system may acquire inlet air from the surrounding environment through an inlet filter 130 and an inlet valve 132 into an inflation plenum 134. Within the inflation plenum 134 may be one or more fans 136, one or more heaters 140, and one or more sensors 150. For example, the sensors 150 may comprise a temperature sensor, air pressure sensor, and so forth.

In this implementation, the inflatable cover 108 comprises a plurality of chambers 306, such as depicted in FIG. 3. Each chamber 306 is connected to the inflation plenum 134 via an inflation valve 402. Each chamber 306 is also connected to the exhaust plenum 162 via an exhaust valve 404. In some implementations one or more of the inflation valve 402 or the exhaust valve 404 may be omitted for one or more chambers 306. For example, the exhaust valves 404 may be omitted.

In another implementation, the inflation valves 402 may be omitted and instead each chamber 306 may be fed with air using a dedicated fan 136. In yet another implementation, the exhaust valves 404 may be omitted and instead each chamber 306 may be exhausted using a dedicated fan 136. Likewise, a single fan 136 may be used to inflate or deflate a chamber 306.

The exhaust plenum 162 may also include one or more sensors 150. In some implementations the exhaust plenum 162 may include one or more fans 136. Exhaust air may be passed from the exhaust plenum 162 via a relief valve 166 and an exhaust filter 168 into the surrounding environment.

The recirculation valve 164 may be used to recirculate air from the exhaust plenum 162 to the inflation plenum 134. For example, when the recirculation valve 164 is opened, air may flow from the exhaust plenum 162 to the inflation plenum 134.

By controlling operation of one or more of the inlet valve 132, the fans 136, the inflation valves 402, the exhaust valves 404, or the relief valve 166, the inflatable cover 108 may be placed into various configurations. A control sequence 410 is shown illustrating various times 412 in the sequence and the corresponding chambers 306 that are inflated 414. When a chamber 306 is to be inflated, the exhaust valve 404 for that chamber 306 is closed and the inflation valve 402 is opened. When a chamber 306 is to be deflated, the inflation valve 402 is closed and the exhaust valve 404 for that chamber 306 is opened. When the air system operates according to the control sequence 410 shown, an asymmetric ripple in the shape of the inflatable cover 108 is produced.

Figure 5:
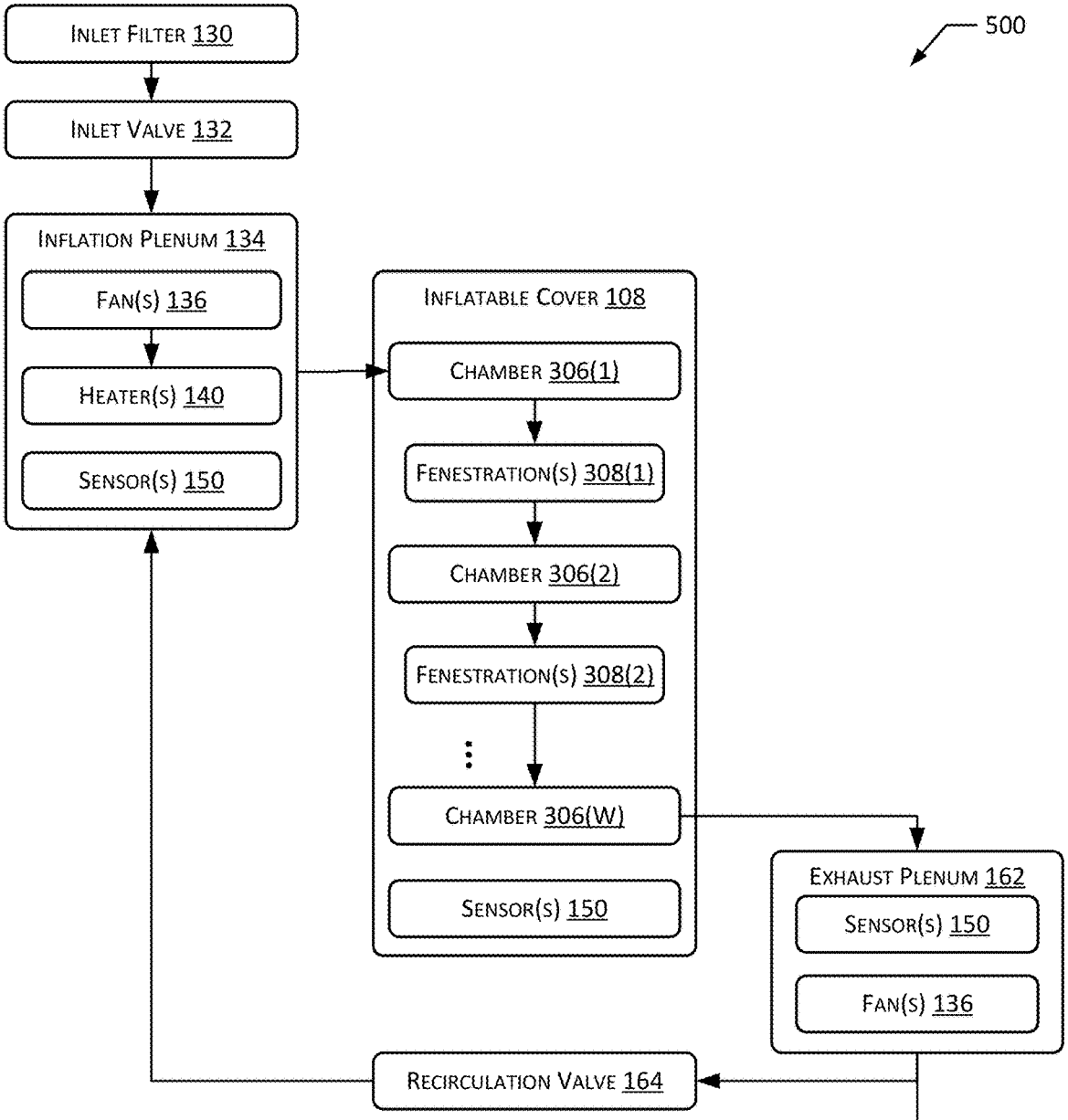
FIG. 5 is a block diagram of a second implementation of the air system of the device and a control sequence, according to some implementations.

FIG. 5 is a block diagram of a second implementation of the air system of the device 100 and a control sequence, according to some implementations.

As described above with regard to FIG. 1, the air system may acquire inlet air from the surrounding environment through an inlet filter 130 and an inlet valve 132 into an inflation plenum 134. Within the inflation plenum 134 may be one or more fans 136, one or more heaters 140, and one or more sensors 150. For example, the sensors 150 may comprise a temperature sensor, air pressure sensor, and so forth.

In this implementation, the inflatable cover 108 comprises a plurality of chambers 306, such as depicted in FIG. 3. Air may pass between chambers 306 via one or more fenestrations 308. Air from the inflation plenum 134 passes into the first chamber 306(1), then through the subsequent fenestrations 308 to the fifth chamber 306(5). The fifth chamber 306(5) is also connected to the exhaust plenum 162.

The exhaust plenum 162 may also include one or more sensors 150. In some implementations the exhaust plenum 162 may include one or more fans 136. Exhaust air may be passed from the exhaust plenum 162 via a relief valve 166 and an exhaust filter 168 into the surrounding environment.

The recirculation valve 164 may be used to recirculate air from the exhaust plenum 162 to the inflation plenum 134. For example, when the recirculation valve 164 is opened, air may flow from the exhaust plenum 162 to the inflation plenum 134.

By controlling operation of one or more of the inlet valve 132, the fans 136, or the relief valve 166, the inflatable cover 108 may be placed into various configurations. A control sequence 510 is shown illustrating various times 512 and corresponding fan speed 514, inlet valve state 516, relief valve state 518, and recirculation valve state 520. When the air system operates according to the control sequence 510 shown, an asymmetrical shape of the inflatable cover 108 is produced over time. For example, the inflatable cover 108 is inflated during times 0 and 1. Air is forced into the first chamber 306(1), inflating it. Some air passes through the first fenestrations 308(1) into the second chamber 306(2), proceeding to inflate that chamber 306(2). This movement of air continues, progressively filling the chambers 306 sequentially. At time 2 the inlet valve 132 and the relief valve 166 are closed, and the recirculation valve 164 is opened, allowing pressure on both the inflation plenum 134 and the exhaust plenum 162 to equalize. At time 3, the relief valve 166 is opened, deflating the inflatable cover 108.

In one implementation, the air system may omit valves. For example, one or more of the inlet valve 132, the recirculation valve 164, or the relief valve 166 may be removed. In such an implementation the fan(s) 136 alone may be used to control inflation of the inflatable cover 108. For example, the fans 136 may operate at high speed to inflate the inflatable cover 108 and may be turned off, allowing the inflatable cover 108 to deflate.

Figure 6:
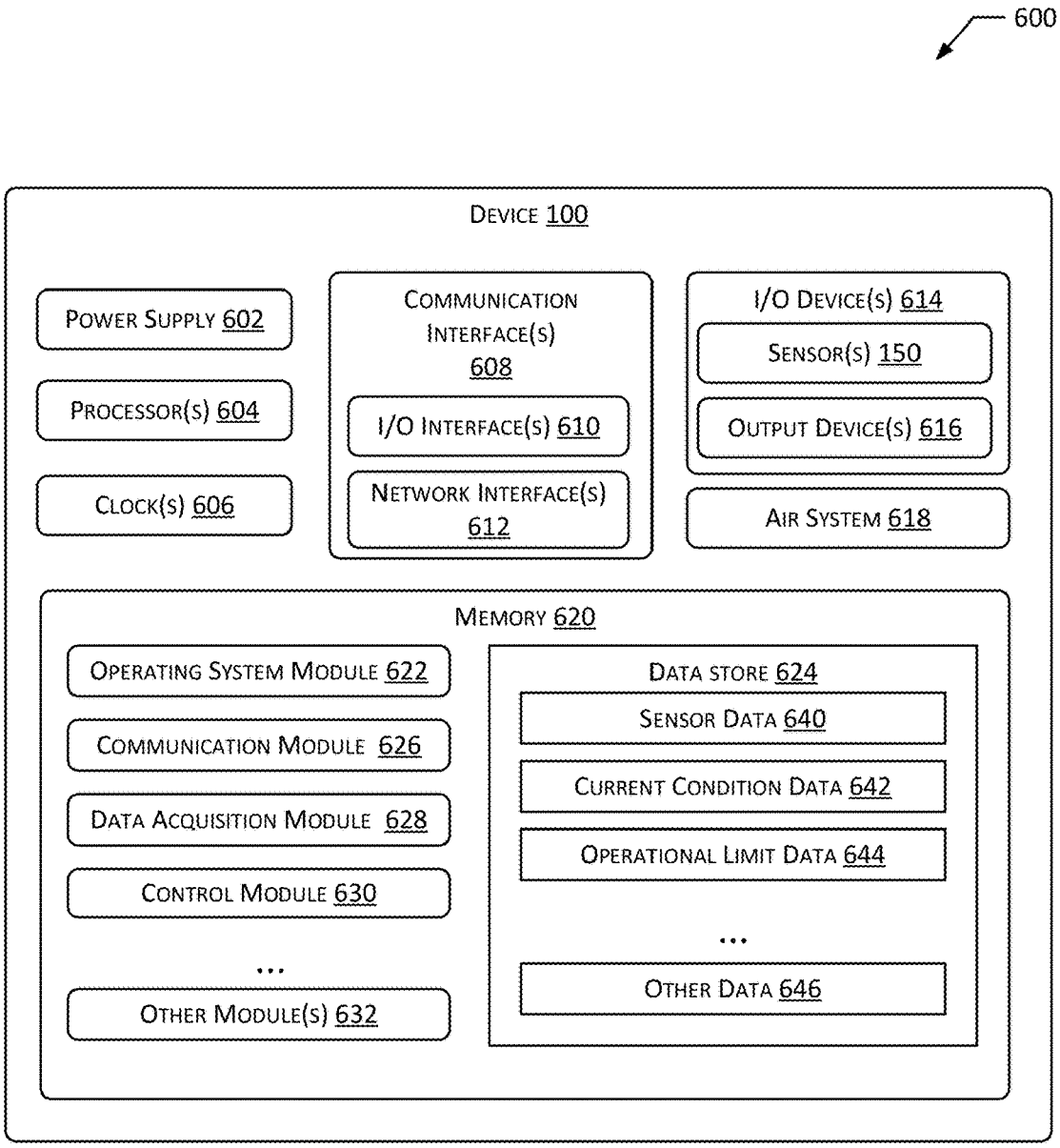
FIG. 6 is a block diagram of some components of the device, according to some implementations.

FIG. 6 is a block diagram 600 of some components of the device 100, according to some implementations.

The device 100 may include a power supply 602. The power supply 602 may comprise one or more components to provide for electrical surge protection, voltage regulation, current regulation, and so forth. In some implementations the power supply 602 may obtain electrical power from a power over ethernet connection, alternating current building mains, and so forth.

The device 100 may include one or more hardware processors 604 (processors) configured to execute one or more stored instructions. The processors 604 may include microcontrollers, systems on a chip, field programmable gate arrays, digital signal processors, graphic processing units, general processing units, and so forth.

One or more clocks 606 may provide information indicative of date, time, ticks, and so forth. For example, the processor 604 may use data from the clock 606 as part of the inputs to calculate an azimuth and elevation to steer a beam from the antenna 120. In another example, the processor 604 may use time data from the clock 606 to determine when to inflate the inflatable cover 108. In some implementations one or more of the clocks 606 may be disciplined from an external source, such as a global position system (GPS) satellite signal.

The device 100 may include one or more communication interfaces 608 such as input/output (I/O) interfaces 610, network interfaces 612, and so forth. The communication interfaces 608 enable the device 100, or components thereof, to communicate with other devices or components.

The I/O interfaces 610 may comprise Inter-Integrated Circuit (I2C), Serial Peripheral Interface bus (SPI), Universal Serial Bus (USB) as promulgated by the USB Implementers Forum, RS-232, and so forth. For example, the I/O interface(s) 610 may couple to one or more I/O devices 614. The I/O devices 614 may include input devices such as one or more of a sensor 150, button, and so forth. The I/O devices 614 may also include output devices 616 such as a light, speaker, buzzer, display, and so forth. In some embodiments, the I/O devices 614 may be physically incorporated with the device 100 or may be externally placed. For example, the device 100 may use an external device such as a smartphone or tablet to present information about the device 100, accept input, and so forth.

The network interfaces 612 may be configured to provide communications between the device 100 and other devices. The network interfaces 612 may include devices configured to couple to personal area networks (PANs), local area networks (LANs), wireless local area networks (WLANS), wide area networks (WANs), and so forth. For example, the network interfaces 612 may include devices compatible with Ethernet, Wi-Fi, Bluetooth, Bluetooth Low Energy, ZigBee, WiMAx, LTE, 5G, satellite communication, and so forth.

The device 100 may also include one or more busses or other internal communications hardware or software that allow for the transfer of data between the various modules and components of the device 100.

The device 100 may include, or be connected to, an air system 618. For example, the air system 618 may comprise one or more of the components described previously, such as various valves, sensors 150, fans 136, heaters 140, and so forth. In some implementations the air system 618 may include a processor 604 to control operation of the components. For example, the air system 618 may utilize a microcontroller to operate the components according to a control sequence.

As shown in FIG. 6, the device 100 includes one or more memories 620. The memory 620 may comprise one or more non-transitory computer-readable storage media (CRSM). The CRSM may be any one or more of an electronic storage medium, a magnetic storage medium, an optical storage medium, a quantum storage medium, a mechanical computer storage medium, and so forth. The memory 620 provides storage of computer-readable instructions, data structures, program modules, and other data for the operation of the device 100. A few example functional modules are shown stored in the memory 620, although the same functionality may alternatively be implemented in hardware, firmware, or as a system on a chip (SoC).

The memory 620 may include at least one operating system (OS) module 622. The OS module 622 is configured to manage hardware resource devices such as the I/O interfaces 610, the I/O devices 614, the communication interfaces 608, and provide various services to applications or modules executing on the processors 604. For example, the OS module 622 may implement a variant of the FreeBSD operating system as promulgated by the FreeBSD Project.

Also stored in the memory 620 may be a data store 624 and one or more of the following modules. These modules may be executed as foreground applications, background tasks, daemons, and so forth. The data store 624 may use a flat file, database, linked list, tree, executable code, script, or other data structure to store information. In some implementations, the data store 624 or a portion of the data store 624 may be distributed across one or more other devices.

A communication module 626 may be configured to establish communication with other devices. For example, the communication module 626 may maintain a satellite communication link with one or more orbiting satellites. In another example, the communication module 626 may establish communication with a computing device such as a smartphone to facilitate setup or maintenance of the device 100. The communications may be authenticated, encrypted, and so forth.

A data acquisition module 628 may be configured to acquire sensor data 640 from one or more of the sensors 150. For example, the data acquisition module 628 may operate the one or more sensors 150 to acquire the sensor data 640 and process the sensor data 640 to determine current condition data 642. In some implementations, the device 100 may acquire one or more of sensor data 640 or current condition data 642 from an external device. For example, sensor data 640 may be received from a separate weather station proximate to the device 100. In another example, the device 100 may receive current condition data 642 from an external source such as a service providing meteorological data.

The data acquisition module 628 may provide various data processing functions. For example, the data acquisition module 628 may determine current condition data 642 from a plurality of individual samples of sensor data 640. In another example the data acquisition module 628 may apply one or more filters to the sensor data 640.

A control module 630 operates the air system 618. The control module 630 may use one or more of sensor data 640, current condition data 642, or operational limit data 644 during operation. The operational limit data 644 may comprise one or more thresholds associated with various parameters. For example, the operational limit data 644 may specify a maximum wind speed for which the inflatable cover 108 may be maintained in the inflated condition 102. The current condition data 642 and the operational limit data 644 are discussed in more detail with regard to FIG. 7.

The control module 630 may operate in conjunction with other modules. For example, the communication module 626 may provide information such as signal to noise level (SNR) about a communication link. If the current SNR is less than a threshold value, the control module 630 may be instructed to operate the air system 618 to shed any accumulated debris from the inflatable cover 108. In another example, the control module 630 may receive information from the communication module 626 that a request to establish a communication link has been received. Responsive to this request, the control module 630 may proceed to inflate the inflatable cover 108. Likewise, when the communication module 626 indicates that the communication link is to be discontinued, the control module 630 may proceed to deflate the inflatable cover 108.

In some implementations, the controller operating the air system 618 may utilize discrete components and techniques. For example, an analog circuit comprising a thermistor may be used to operate the fan 136 when the temperature drops below a threshold amount.

The device 100 may include other modules 632 and utilize other data 646. For example, a pass prediction module may use stored information about the geographic location of the device 100 on the Earth, orientation 206, time data from the clock 606, and orbital element data to determine when a particular satellite is expected to be in view of the antenna 120, and the azimuth and elevation to operate a phased array antenna to provide beamforming in that direction.

Figure 7:
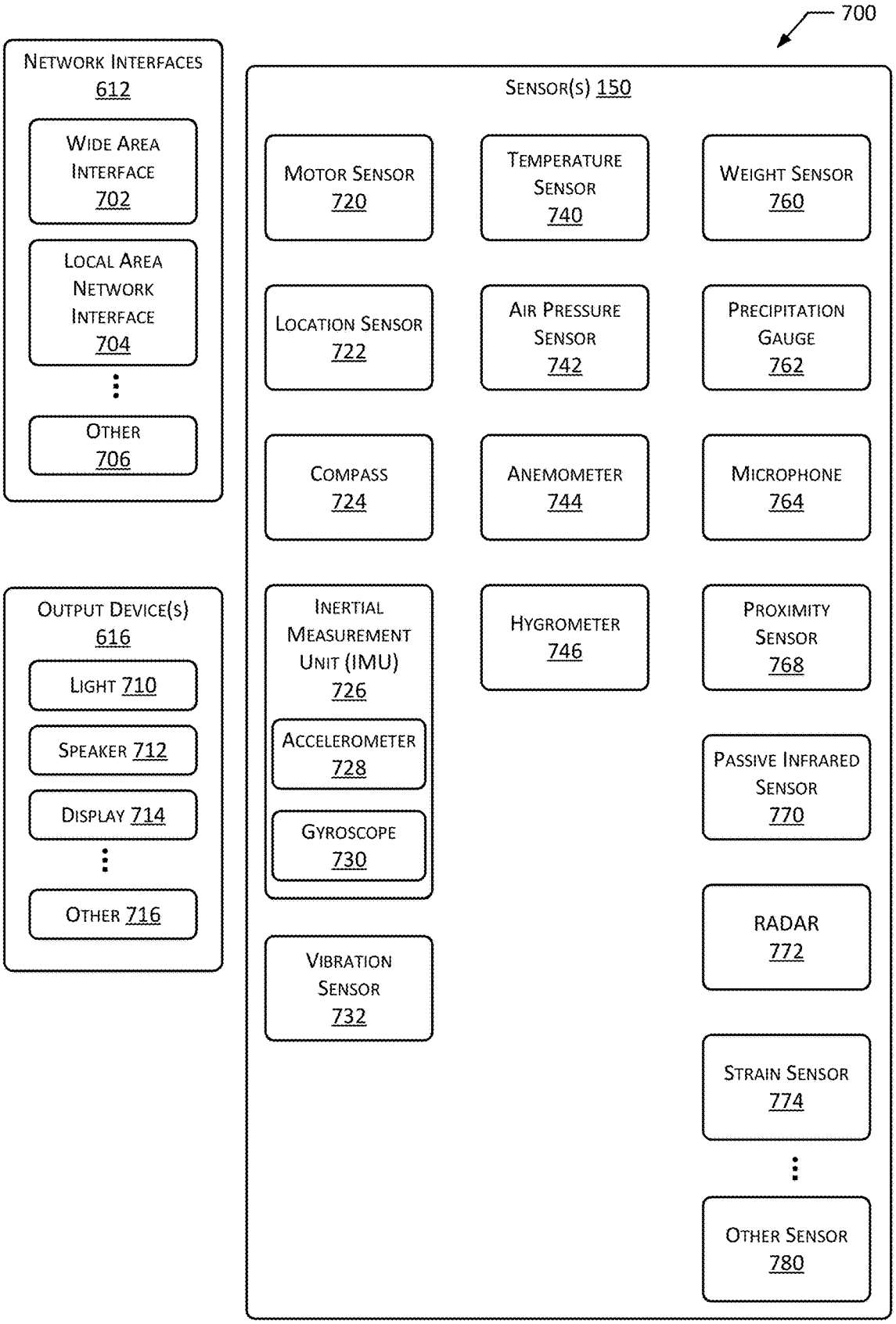
FIG. 7 is a block diagram of some components, including sensors that may be used to control inflation of the removeable inflatable cover, according to some implementations.

FIG. 7 is a block diagram 700 of some components, including sensors 150 that may be used by the air system 618 to control inflation of the removeable inflatable cover 108, according to some implementations.

The device 100 may include one or more network interfaces 612, such as a wide area interface 702 and a local area network interface 704. The wide area interface 702 may comprise one or more radio transmitters, receivers, modems, and other devices to establish a radio communication link with another station. For example, the wide area interface 702 may comprise Ka-band transceivers for use with the antenna 120 to establish a communication link with a non-geosynchronous satellite. In another example, the wide area interface 702 may comprise transceivers for use with the antenna 120 to establish a communication link with an aerostat or other aerial platform.

The local area network interface 704 may provide communication with other computing devices local to the device 100. For example, the local area network interface 704 may comprise a wired Ethernet interface, wireless WiFi interface, and so forth.

The network interfaces 612 may also other interfaces 706. For example, the other interface 706 may comprise a Bluetooth interface to establish communication with nearby devices such as sensors 150, service equipment, and so forth.

The device 100 may include one or more output devices 616. A light 710 may be used to emit photons. A speaker 712 may be used to emit sound. A display 714 may comprise one or more of a liquid crystal display, light emitting diode display, electrophoretic display, cholesteric liquid crystal display, interferometric display, and so forth.

In some implementations the output devices 616 may be used to dissuade wildlife from residing on the device 100. For example, an LED light 710 mounted on the upper housing 112 may be occasionally operated as a strobe light to encourage wildlife to leave. In another example, the speaker 712 may be used to play a sound to encourage wildlife to leave.

The output devices 616 may also include other output devices 716. For example, a motor or other actuator may be used to electronically adjust the retention band 110 to loosen or tighten the retention band 110.

The device 100 may include, or obtain sensor data 640 from, one or more sensors 150. A motor sensor 720 may comprise one or more sensors 150 that are incorporated in the motors of the fans 136 or the electronics driving those motors. For example, the motor sensor 720 may comprise hall effect sensors that provide information as to the angular position of a portion of the motor, rotation rate, and so forth. In another example, the motor sensor 720 may comprise circuitry to determine a back electromotive force (EMF) of the motor.

A location sensor 722 provides information about a geographic location such as particular coordinates indicative of latitude and longitude, or displacement with respect to a predefined origin. The location sensor 722 may comprise an optical, radio, or other navigational system such as a global positioning system (GPS) receiver, GLONASS receiver, and so forth.

A compass 724 may provide information about a relative direction of the Earth's magnetic field. For example, the compass 724 may comprise one or more magnetometers that provide information about the orientation 206 of the device 100 relative to the earth's magnetic field.

The sensors 150 may include an inertial measurement unit (IMU) 726. The IMU 726 may include one or more of an accelerometer 728 or a gyroscope 730 (or gyrometer). The accelerometer 728 provides information indicative of a direction and magnitude of an imposed acceleration. Data such as rate of change, determination of changes in direction, velocity, and so forth may be determined using the accelerometer 728. The accelerometer 728 may comprise mechanical, optical, micro-electromechanical, or other devices. For example, the accelerometer 728 may comprise a prepackaged solid-state device that provides multiple axis accelerometers 728.

The gyroscope 730 (or gyrometer) may provide information indicative of rotation of an object affixed thereto. For example, the gyroscope 730 may generate sensor data 640 that is indicative of a change in angular orientation of the device 100 or a portion thereof with respect to an axis. The gyroscope 730 may comprise mechanical, optical, micro-electromechanical, or other devices. For example, the gyroscope 730 may comprise a prepackaged solid-state device that provides multiple axis gyroscopes 730.

A vibration sensor 732 provides information about mechanical vibration associated with at least a portion of the device 100. For example, the vibration sensor 732 may comprise a micro-electromechanical device that detects mechanical motion. In some implementations the IMU 726 may be operated as a vibration sensor.

The sensors 150 may include temperature sensors 740 to provide information indicative of the temperature of a component, air temperature, and so forth. The temperature sensor 740 may comprise a thermocouple, thermistor, or other device. In some implementations, an infrared temperature sensor may be utilized.

An air pressure sensor 742 provides information about air pressure. For example, the air pressure sensor 742 may comprise a piezoelectric, micro-mechanical, resistive, or other device that measures a relative difference in the pressure of air proximate to a transducer. In some implementations data from the air pressure sensor 742 may be used to determine if material has accumulated on the inflatable cover 108. For example, if the air pressure sensor 742 indicates an increase in pressure within the interior of the inflatable cover 108 to a plenum open into the interior that does not correspond to operation of the fans 136, a determination may be made that there is a load on the inflatable cover 108.

An anemometer 744 may provide information such as wind speed, wind direction, and so forth. The anemometer 744 may utilize one or more of mechanical, electrical, acoustic, or optical components.

A hygrometer 746 provides information about water vapor present in the air. The hygrometer 746 may utilize one or more of electrical, optical, or other components.

A weight sensor 760 provides weight data about an applied load. For example, a weight sensor comprising a load cell may be incorporated into the mounting post 118 to provide information about the weight of the device 100. The weight data may be used to determine accumulation of debris on the device 100.

A precipitation gauge 762 provides information about precipitation such as rain, snow sleet, and so forth. For example, the precipitation gauge 762 may comprise a weight precipitation gauge.

A microphone 764 comprises a transducer to convert vibrations in the air or another medium into a signal. In some implementations a microphone 764 may be mounted to detect sounds associated with operation of the fans 136, the sound of wind, and so forth.

A proximity sensor 768 provides information about whether an object is within range of the device 100. The proximity sensor 768 may comprise an optical time of flight (ToF) device that emits an optical signal and detects a reflection to determine if an object is present and if so, a distance to that object. The proximity sensor 768 may comprise an ultrasonic transducer to emit and detect ultrasonic signals. The proximity sensor 768 may comprise a capacitive device, detecting a change in capacitance at an electrode due to the presence of an object. In some implementations one or more components of the antenna 120 may be used as part of a proximity sensor 768.

A passive infrared sensor 770 may comprise a detector to determine the presence of infrared radiation associated with a living object. For example, the passive infrared sensor 770 may comprise an infrared photocell that is sensitive to a body temperature of wildlife.

The sensors 150 may include a radar 772. The radar 772 may be used to determine the presence of an object, and in some implementations one or more of distance or direction to that object. In some implementations the wide area interface 702 may be operated as a radar 772 to determine information about whether debris has accumulated on the device 100.

One or more strain sensors 774 may provide information about the mechanical strain on components in the device 100. For example, the strain sensors 774 may be affixed to one or more portions of the inflatable cover 108, the retention band 110, the cover engagement feature 208, a support frame within the housing 106, the upper housing 112, the mounting post 118, and so forth. Continuing the example, a strain sensor 774 proximate to the cover engagement feature 208 may be used to determine if the retention band 110 is securely affixed to the housing 106.

In other implementations, other sensors 780 may be used. For example, the sensors 150 may include an ambient light sensor, thunderstorm detector, solar radiation sensor, and so forth.

The sensor data 640 from the one or more sensors 150 may be used by the control module 630 to maintain the inflatable cover 108 in a condition that is appropriate to the environmental conditions.

FIG. 8 illustrates at 800 operational limit data 644 and current condition data 642 that may be used to control inflation of the removeable inflatable cover 108, according to some implementations. The operational limit data 644 may include one or more parameters 802, and limits for those parameters such as a minimum limit 804, maximum limit 806, and so forth.

The parameters 802 may include, but are not limited to, wind speed, wind direction, temperature, precipitation, relative humidity, barometric pressure, motor back EMF, motor current, accelerometer output, tilt angle, vibration, strain value, and so forth. For example, the parameter 802 of wind speed has a minimum limit 804 of 0 m/s and a maximum limit 806 of 14 m/s. Constraints on parameters, such as the minimum limit 804 and maximum limit 806, may be predetermined. These constraints may also interrelate with one another. For example, a first maximum limit 806 for wind speed of wind moving in a relative direction of front-to-back with respect to the orientation 206 of the device 100 may be greater than a second maximum limit 806 for wind speed of wind moving in a relative direction of left-to-right with respect to the orientation 206.

The current condition data 642 comprises one or more parameters 802 and associated condition values 808. For example, the current condition data 642 may indicate the current wind speed is 17 m/s with the wind coming from the direction of 3 degrees relative to the orientation 206 of the device 100. The current condition data 642 may be obtained from one or more sensors 150 onboard the device 100, or from external devices. For example, current condition data 642 about meteorological parameters may be received from a weather reporting service.

The control module 630 may compare the current condition data 642 to the operational limit data 644 to direct operation of the air system 618. For example, a particular control sequence may be associated with a particular combination of current condition data 642 and operational limit data 644.

Figure 9:
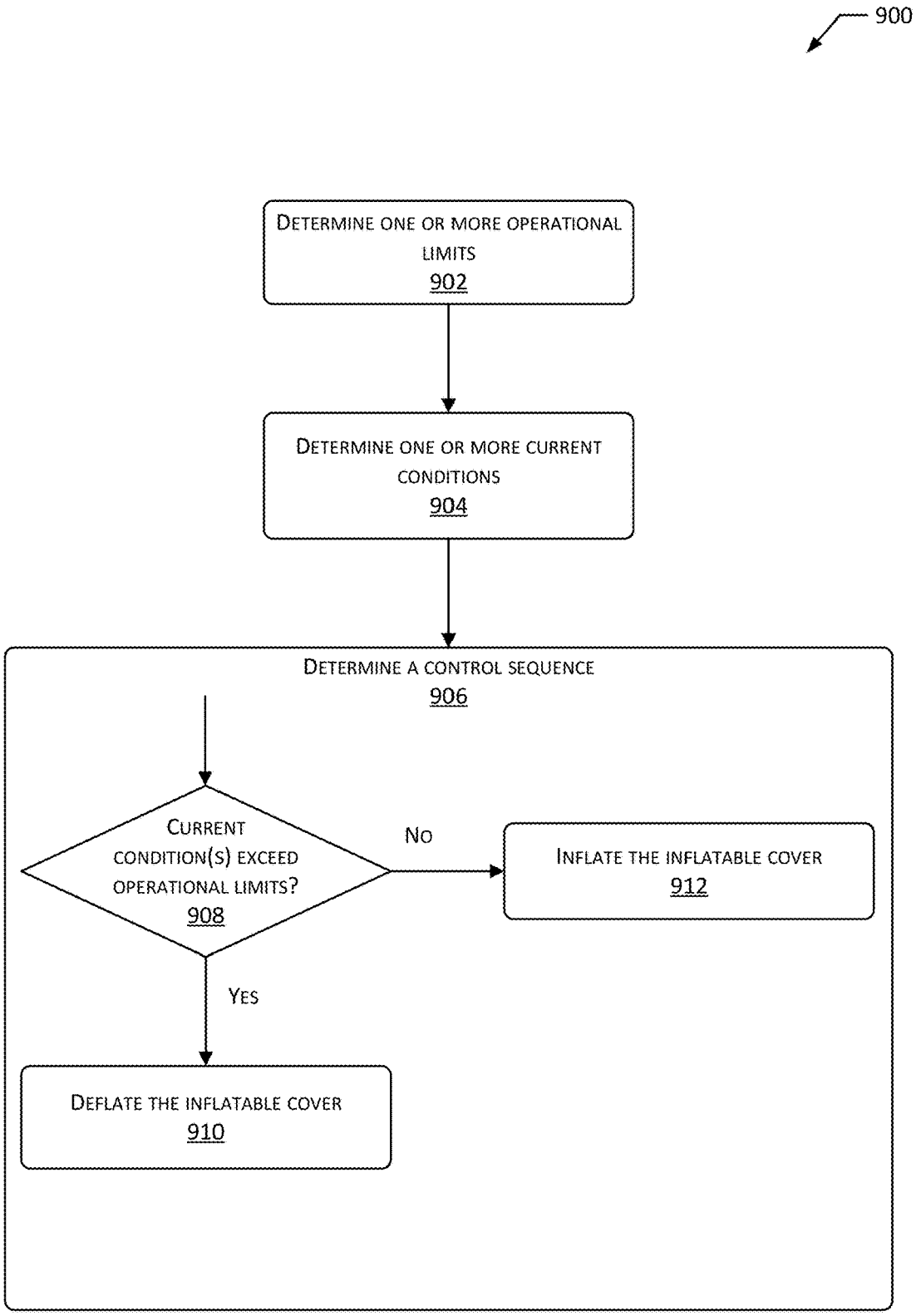
FIG. 9 is a flow diagram of a process for controlling inflation of the removeable inflatable cover, according to some implementations.

FIG. 9 is a flow diagram 900 of a process for controlling inflation of the removeable inflatable cover 108, according to some implementations. The process may be implemented at least in part by the device 100. For example, the control module 630 may operate the air system 618 as described herein.

At 902 one or more operational limits are determined. For example, operational limit data 644 may specify limits or constraints associated with various parameters 802.

At 904 current condition data 642 indicative of one or more current conditions is determined. For example, sensors 150 are used to acquire sensor data 640 about the device 100, the environment around the device 100, and so forth.

At 906 a control sequence is determined based at least in part on the current condition data 642 and the operational limit data 644. For example, at 908 the current conditions indicated by current condition data 642 are compared to the operational limit data 644. If the values of the current conditions exceed one or more operational limits, the process may proceed to 910.

At 910 a first control sequence is selected and used to operate the air system 618 to deflate the inflatable cover 108. For example, the air system 618 may deactivate the fans 136 and open the inlet valve 132 and the relief valve 166. In another example, the air system 618 may actively withdraw at least a portion of the air from within the inflatable cover 108 by closing the relief valve 166, opening the inlet valve 132, and operating the fans 136 in reverse to move air from inside the inflatable cover 108 to the surrounding environment.

If at 908 the current conditions indicated by the current condition data 642 do not exceed one or more operational limits specified by the operational limit data 644, the process may proceed to 912.

At 912 a second control sequence is selected and used to operate the air system 618 to inflate the inflatable cover 108. For example, the air system 618 may open the inlet valve 132, close the relief valve 166, and operate the fans 136 to move air into the inflatable cover 108.

The control sequence 906 used to operate the air system 618 may vary from time to time. The control module 630 may assess the current condition data 642 at a predetermined interval, on demand from another module, responsive to sensor data 640, and so forth. For example, the wind speed remains within the constraints but may be particularly gusty and change directions quickly. As a result, the vibration experienced by the device 100 may exceed a threshold value. Responsive to that vibration, the control module 630 may direct the air system 618 to deflate the inflatable cover 108. In another example, responsive to the temperature dropping below freezing, the heaters 140 may be activated and a control sequence used to move the inflatable cover 108 as described in FIG. 3 to avoid the buildup of ice or snow may be selected.

The processes and methods discussed in this disclosure may be implemented in hardware, software, or a combination thereof. In the context of software, the described operations represent computer-executable instructions stored on one or more computer-readable storage media that, when executed by one or more hardware processors, perform the recited operations. Generally, computer-executable instructions include routines, programs, objects, components, data structures, and the like that perform particular functions or implement particular abstract data types. Those having ordinary skill in the art will readily recognize that certain steps or operations illustrated in the figures above may be eliminated, combined, or performed in an alternate order. Any steps or operations may be performed serially or in parallel. Furthermore, the order in which the operations are described is not intended to be construed as a limitation.

Embodiments may be provided as a software program or computer program product including a non-transitory computer-readable storage medium having stored thereon instructions (in compressed or uncompressed form) that may be used to program a computer (or other electronic device) to perform processes or methods described herein. The computer-readable storage medium may be one or more of an electronic storage medium, a magnetic storage medium, an optical storage medium, a quantum storage medium, and so forth. For example, the computer-readable storage medium may include, but is not limited to, hard drives, floppy diskettes, optical disks, read-only memories (ROMs), random access memories (RAMs), erasable programmable ROMs (EPROMs), electrically erasable programmable ROMs (EEPROMs), flash memory, magnetic or optical cards, solid-state memory devices, or other types of physical media suitable for storing electronic instructions. Further embodiments may also be provided as a computer program product including a transitory machine-readable signal (in compressed or uncompressed form). Examples of transitory machine-readable signals, whether modulated using a carrier or unmodulated, include, but are not limited to, signals that a computer system or machine hosting or running a computer program can be configured to access, including signals transferred by one or more networks. For example, the transitory machine-readable signal may comprise transmission of software by the Internet.

Separate instances of these programs can be executed on or distributed across any number of separate computer systems. Thus, although certain steps have been described as being performed by certain devices, software programs, processes, or entities, this need not be the case, and a variety of alternative implementations will be understood by those having ordinary skill in the art.

Additionally, those having ordinary skill in the art will readily recognize that the techniques described above can be utilized in a variety of devices, physical spaces, and situations. Although the subject matter has been described in language specific to structural features or methodological acts, it is to be understood that the subject matter defined in the appended claims is not necessarily limited to the specific features or acts described. Rather, the specific features and acts are disclosed as illustrative forms of implementing the claims.

What is claimed is:

1. A device comprising:

a housing having an upper section and a lower section;

an antenna within the housing;

a removeable inflatable cover that is affixed proximate to the upper section;

an air system including a fan;

a sensor; and a controller to:

determine, at a first time, first data from the sensor;

responsive to the first data, operate the air system to inflate the removeable inflatable cover by operating one or more inflation valves to direct air from the fan to one or more chambers in the removeable inflatable cover;

determine, at a second time, second data from the sensor; and responsive to the second data, operate the air system to deflate the removeable inflatable cover by operating one or more exhaust valves to direct air from the one or more chambers to a surrounding environment.

2. The device of claim 1, the sensor comprising one or more of: a weight sensor or a proximity sensor; and the controller to:

determine, based on the first data, presence of material on the upper section or the removeable inflatable cover; and determine, based on the second data, absence of material on the upper section or the removeable inflatable cover.

3. The device of claim 1, the sensor comprising an anemometer; and the controller to:

determine, based on the first data, that wind speed at the first time is less than a first threshold; and determine, based on the second data, that wind speed at the second time is greater than a second threshold.

4. The device of claim 1, the controller to:

determine, based on the first data, movement of the device or a portion thereof at the first time is less than a first threshold; and determine, based on the second data, movement of the device or a portion thereof at the second time is greater than a second threshold.

5. The device of claim 1, further comprising:

an engagement feature arranged around a perimeter of the housing; and a retention band that engages a portion of the removeable inflatable cover and retains the portion within the engagement feature.

6. The device of claim 1, further comprising:

a ridge on the upper section, wherein the ridge facilitates inflation of the removeable inflatable cover when a load is present on at least a portion of the removeable inflatable cover.

7. The device of claim 1, the controller to operate the air system to deflate the removeable inflatable cover to:

withdraw at least a portion of air from within the removeable inflatable cover.

8. The device of claim 1, the removeable inflatable cover comprising:

one or more fenestrations between adjacent chambers of the one or more chambers.

9. A device comprising:

a housing;

an air system having a first plenum;

a removeable inflatable cover that is affixed to the housing, wherein an interior of the removeable inflatable cover is in communication with the first plenum of the air system, and wherein the removeable inflatable cover comprises a first chamber, a second chamber, and a third chamber;

a first valve having an inlet connected to the first plenum and an outlet connected to the first chamber;

a second valve having an inlet connected to the first plenum and an outlet connected to the second chamber;

a third valve having an inlet connected to the first plenum and an outlet connected to the third chamber;

an antenna, wherein the antenna is covered by the removeable inflatable cover; and a controller to:

determine first data;

determine, based on the first data, a first control sequence; and operate one or more of the first valve, the second valve, or the third valve, based on the first control sequence, to move air between an external environment and the interior of the removeable inflatable cover.

10. The device of claim 9, further comprising:

an engagement feature arranged around a perimeter of the housing; and a retention band that engages a portion of the removeable inflatable cover and retains that portion within the engagement feature.

11. The device of claim 9, further comprising:

a ridge on an upper surface of the housing, wherein the ridge facilitates inflation of the removeable inflatable cover when a load is present on at least a portion of the removeable inflatable cover.

12. The device of claim 9, further comprising:

one or more sensors, wherein the first data is based on output from the one or more sensors; and the one or more sensors comprising:

a compass,
an accelerometer,
a gyroscope,
a temperature sensor,
an air pressure sensor,
an anemometer,
a hygrometer,
a weight sensor,
a precipitation gauge,
a microphone,
a proximity sensor,
a radar, or
a strain sensor.

13. The device of claim 9, wherein the air system includes a fan, the first control sequence comprising one or more of:

instructions to operate the fan at a predetermined speed for a predetermined time, instructions to operate the one or more of the first valve, the second, valve, or the third valve to direct air from the fan to one or more of the first chamber, the second chamber, or the third chamber, or instructions to operate one or more exhaust valves to direct air from the one or more of the first chamber, the second chamber, or the third chamber to the external environment.

14. The device of claim 9, the removeable inflatable cover further comprising:

one or more fenestrations between adjacent chambers of the first, second, and third chambers.

15. The device of claim 9, wherein the first data is indicative of one or more of:

orientation of the device,
acceleration of at least a portion of the device,
rotation of at least a portion of the device,
temperature of one or more of a portion of the device or the external environment,
air pressure,
wind speed,
wind direction,
humidity of the external environment,
weight of at least a portion of the device,
precipitation,
sound of one or more of a portion of the device or the external environment,
proximity of an object, or
mechanical strain on one or more portions of the device.

16. The device of claim 9, the controller to:

receive current condition data indicative of one or more conditions associated with the device;

retrieve operational limit data associated with operation of the device; and wherein the first data is based at least in part on the current condition data and the operational limit data.

17. The device of claim 9, the controller to operate the air system to evacuate air from within the removeable inflatable cover.

18. A method comprising:

determining first data that is indicative of one or more conditions associated with a device comprising an antenna covered by a removeable inflatable cover;

determining, based on the first data, a first sequence; and operating an air system using the first sequence to move air between one or more chambers of the removeable inflatable cover and an external environment, wherein the first sequence indicates a first set of the one or more chambers to be inflated at a first time and a second set of the one or more chambers to be inflated at a second time.

19. The method of claim 18, further comprising:

receiving, via a network connection, second data from an external computing device, wherein the second data is indicative of wind speed;

determining, based on the second data, a second sequence; and operating the air system using the second sequence to evacuate the removeable inflatable cover.

20. A device comprising:

a housing having an upper section and a lower section;

an antenna within the housing;

a removeable inflatable cover that is affixed proximate to the upper section;

an air system;

a sensor comprising one or more of: a weight sensor or a proximity sensor; and a controller to:

determine, at a first time, first data from the sensor;

determine, based on the first data, presence of material on the upper section or the removable inflatable cover;

responsive to the first data and the presence of the material, operate the air system to inflate the removeable inflatable cover;

determine, at a second time, second data from the sensor;

determine, based on the second data, absence of material on the upper section or the removeable inflatable cover; and responsive to the second data and the absence of the material, operate the air system to deflate the removeable inflatable cover.

* * * * *